US011489284B2

(12) United States Patent
Regnier et al.

(10) Patent No.: US 11,489,284 B2
(45) Date of Patent: Nov. 1, 2022

(54) CONNECTOR FOR WATERTIGHT CONNECTION

(71) Applicant: Aptiv Technologies Limited, St. Michael (BB)

(72) Inventors: Vincent Regnier, Spardorf (DE); Frank Odoerfer, Röthenbach an der Pegnitz (DE); Christian Neubert, Fürth (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/985,053

(22) Filed: Aug. 4, 2020

(65) Prior Publication Data

US 2021/0044051 A1 Feb. 11, 2021

(30) Foreign Application Priority Data

Aug. 5, 2019 (EP) ..... 19189989

(51) Int. Cl.

| | |
|---|---|
| ***H01R 13/627*** | (2006.01) |
| ***H01R 13/52*** | (2006.01) |
| ***H01R 13/04*** | (2006.01) |
| ***H01R 13/502*** | (2006.01) |
| ***H01R 13/639*** | (2006.01) |

(52) U.S. Cl.

CPC ..... *H01R 13/5202* (2013.01); *H01R 13/04* (2013.01); *H01R 13/502* (2013.01); *H01R 13/521* (2013.01); *H01R 13/639* (2013.01); *H01R 2201/26* (2013.01)

(58) Field of Classification Search

CPC ..... H01R 2103/00; H01R 13/6272; H01R 13/6275; H01R 13/5202; H01R 13/04; H01R 13/502; H01R 13/521; H01R 13/639; H01R 2201/26

See application file for complete search history.

(56) References Cited

U.S. PATENT DOCUMENTS 4,736,999 A 4/1988 Michael et al.
5,275,575 A * 1/1994 Cahaly ..... H01R 13/7032 439/352

(Continued)

FOREIGN PATENT DOCUMENTS

CN 101043108 9/2007
CN 202712652 1/2013

(Continued)

OTHER PUBLICATIONS

"Extended European Search Report", EP Application No. 19189989.7, dated Nov. 25, 2019, 14 pages.

(Continued)

*Primary Examiner* — Thanh Tam T Le
(74) *Attorney, Agent, or Firm* — Colby Nipper PLLC

(57) ABSTRACT

A connector is disclosed for mating with a counter-connector. The connector comprises a sleeve defining a recess and being adapted to receive the counter-connector at least partially. The connector further comprises one or more contact pins located in the recess and extending along a mating direction of the connector. Further, a connector system is discloses comprising a connector and a counter-connector. Further, a retainer is disclosure for use in a connector or a connector system.

20 Claims, 5 Drawing Sheets

(56) References Cited

U.S. PATENT DOCUMENTS 5,314,345 A * 5/1994 Cahaly ..... H01R 13/6392 439/188
5,613,865 A * 3/1997 Dullin ..... H01R 13/6273 439/188
5,688,141 A * 11/1997 Dullin ..... H01R 13/639 439/188
5,924,885 A * 7/1999 Pacher ..... H01R 13/6273 439/352
6,217,388 B1 * 4/2001 Francis ..... H01R 13/7197 439/942
6,276,953 B1 * 8/2001 Gauker ..... H01R 13/7032 439/188
6,402,540 B1 * 6/2002 Kuhmel ..... H01R 13/64 439/352
6,419,510 B2 * 7/2002 Shiraki ..... H01R 13/7032 439/188
6,422,897 B1 * 7/2002 Odorfer ..... H01R 13/7032 439/188
6,544,060 B2 * 4/2003 Wakui ..... H01R 13/7032 439/188
6,786,746 B2 * 9/2004 Nagamine ..... H01R 13/7032 439/620.01
6,910,902 B2 * 6/2005 Osada ..... B60R 21/26 439/188
7,121,867 B2 * 10/2006 Annecke ..... H01R 13/6273 439/352
7,306,474 B1 * 12/2007 Brown ..... H01R 43/26 439/352
7,351,089 B2 * 4/2008 Neale, III ..... H01R 13/6277 439/352
8,257,108 B2 * 9/2012 Brown ..... H01R 43/20 439/378
9,147,971 B2 * 9/2015 Osada ..... H01R 13/641
10,236,640 B2 * 3/2019 Pamart ..... H01R 13/6273
2017/0294742 A1 10/2017 Jodon De Villeroche et al.

FOREIGN PATENT DOCUMENTS

| | | |
|---|---|---|
| CN | 103444015 | 12/2013 |
| CN | 104969421 | 10/2015 |
| CN | 105261881 | 1/2016 |
| CN | 105683795 | 6/2016 |
| CN | 109818198 | 5/2019 |
| EP | 1079474 | 2/2001 |
| EP | 2218146 | 7/2016 |
| EP | 3166185 | 5/2017 |
| JP | 2003243122 | 8/2003 |
| JP | 2015109147 | 6/2015 |
| WO | 2010026449 | 3/2010 |
| WO | 2010070391 | 6/2010 |

OTHER PUBLICATIONS

"Foreign Office Action", CN Application No. 202010771787.7, dated Oct. 9, 2021, 12 pages.
"Foreign Office Action", CN Application No. 202010771787.7, dated Jul. 5, 2022, 13 pages.

* cited by examiner

CONNECTOR FOR WATERTIGHT CONNECTION

RELATED APPLICATIONS

This application claims priority to European Patent Application Number 19189989.7, filed on Aug. 5, 2019, the disclosure of which is incorporated by reference herein.

TECHNICAL FIELD

The present disclosure generally relates to a connector for mating with a counter-connector, particularly wherein the connection is watertight. The disclosure further relates to a respective connector system, and a retainer for use in a connector or connector system.

BACKGROUND ART

Connectors for mating with counter-connectors are generally known in the art. A connector may comprise one or more contact pins for connecting to respective mating contacts of a counter-connector. Upon mating, the connector and counter-connector may be plugged into each other, for establishing an electrical connection between the contact pins and mating contacts. Such connectors may be used in automobile technology, for example, in order to produce an electrical connection, for example for providing an electrical contact in an airbag system. An example of a connector is disclosed in document EP 1 079 474 A1.

FIG. 1 illustrates a cross-sectional view of a connector 1 of the prior art. The connector 1 comprises two contact pins 2 (only one visible in the figure), which may be provided with a bridgewire in-between. The contact pins 2 are provided in a recess 3 defined by a sleeve 4. On the interior side of the sleeve 4, a locking groove 5 is formed. When connecting the connector 1 to a respective counter-connector (not shown), respective locking means of the counter-connector may engage the locking groove 5, in order to lock or secure the counter-connector to the connector 1. Such connectors are defined in the ISO standard 19072-1, for example. This standard specifies a length of the contact pins of 6.45 mm.

These connectors of the prior art have a certain defined size and geometry, which does not allow for achieving a watertight pyrotechnical connection. It is also difficult to reduce the size of such connectors. Further, the prior art connectors typically require metal components for stabilizing the physical connection, which comes along with high manufacturing costs.

There thus exists a need for a connector which allows for a watertight connection with a respective counter-connector. A further need exists for a connector which can be produced with reduced costs. There is a further need relating to reducing the overall size requirements of connectors. The overall manufacturing process shall thereby remain unaffected as far as possible.

These and other needs, which become apparent to the person skilled in the art when reading the following description, are addressed at least partially by the subject matter of the independent claims.

SUMMARY

The present disclosure relates to a connector for mating with a respective counter-connector. Thus, the connector is adapted to be mated with the counter-connector, for example to establish an electrical connection. The connector may be used in automobile technology, for example as a pyrotechnical connector, which may be used for airbags. Optionally, the connector is a plug connector, or may be a scoop-proof plug connector.

The connector comprises a sleeve. The sleeve may be part of a housing or body of the connector. The sleeve defines a recess. In an embodiment, the sleeve may be of an oval shape, optionally of an elliptic or round shape. For example, the sleeve may have a round shape with a diameter of about 11 mm. The recess may have a corresponding shape, as the outer dimensions of the recess are defined by the sleeve. For example, the recess may have a cylindrical shape, wherein a main axis of the cylindrical shape coincides with a mating direction of the connector. The sleeve is adapted to receive the counter-connector (or a plug-in projection thereof) at least partially. Thus, upon mating, a housing or body of the counter-connector may be inserted into the recess defined by the sleeve at least partially. The sleeve may thereby provide for a form-fit and may optionally also a force-fit connection to the counter-connector.

The connector further comprises one or more contact pins. The contact pins are located in the recess defined by the sleeve, and extend along the mating direction of the connector. Thus, upon mating, the contact pins may establish an electrical connection with respective mating contacts of the counter-connector. The contact pins may be gold-plated. The person skilled in the art understands that it may be generally desired to reduce the length of such gold-plated contact pins in order to reduce manufacturing costs.

The connector further comprises a securing element which is located in the recess away from the sleeve. Thus, the securing element is not provided at the sleeve. Optionally, the sleeve may be clear from any such securing elements. The securing element located in the recess away from the sleeve comprises securing means for securing the connector to the counter-connector. Thus, the connector may be secured or even locked to the counter-connector by means of the securing means of the securing element. The connector may be secured directly or indirectly to the counter-connector. In other words, after mating, the securing element may directly engage the counter-connector for providing the securing function, or indirectly via a further part, such as for example a retainer, as detailed further below.

According to the present disclosure, securing means are provided at the securing element, which is located in the recess away from the sleeve. Thus, the sleeve can be provided without any such securing means. This allows for reducing the length of the sleeve, for example, and thus also the length of the contact pins, eventually reducing manufacturing costs. Also, as the sleeve does not need to perform the securing function now provided by the securing element, the sleeve can be made of a plastic material only, thus reducing cost. Further, as no securing means need to be provided at the sleeve, it is possible to provide a watertight connection. For example, sealing means can be provided which, when the connector is mated with the counter-connector, may be located between the sleeve and the counter-connector.

Optionally, the inner surface of the sleeve is essentially smooth. Thus, the inner surface of the sleeve may not have any edges or angled features, such as for example securing means for securing or locking the connector to the counter-connector. Despite the curvature defined by the roundish shape of the sleeve, the inner surface may be essentially flat. The person skilled in the art understands that the sleeve may have one or more apertures required for producing the connector for example via injection molding, however such apertures are not considered as disrupting the smoothness of the sleeve. The sleeve with such production-related apertures is still considered as essentially smooth as it does not feature any means for securing or locking the connector to the counter-connector, or to a retainer.

The connector according to the present disclosure may feature a sealing surface at the inner surface of the sleeve. Thus, a watertight connection can be achieved, in addition to a secure connection between the connector and the counter-connector. Further, due to the provision of the securing element away from the sleeve, the overall size of the connector can be reduced.

Optionally, the sleeve of the connector may extend farther along the mating direction of the connector than the one or more contact pins or the securing element. Thus, the sleeve may reach over the contact pins and/or the securing element along the mating direction. Thus, the sleeve provides a protective role as it covers the contact pins and/or securing element.

Optionally, the one or more contact pins may be encompassed by the securing element at least partially. Thus, the securing element may reach over the contact pins. The securing element may thus provide a protective role as it covers the contact pins at least partially.

Optionally, the length of the one or more contact pins may be in the range of 3.4-6.4 mm, optionally in the range of 3.8-6.0 mm, optionally in the range of 4.2-5.6 mm, optionally in the range of 4.6-5.2 mm, optionally in the range of 4.8-5.0 mm, or optionally of about 4.9 mm. The length of the contact pins may be defined as the length from the base of the recess to the tip of the contact pins. The respective lengths of the securing element and sleeve, again measured from the base of the recess, may be larger than that of the contact pins for protecting the contact pins. Thus, contact pins of reduced length can be used, reducing the production costs.

Optionally, the securing element with the securing means may be formed integrally with the sleeve, for example by means of injection molding. Thus, the sleeve and the securing element may be integrally formed, for example, in or with a body part of the connector. Thus, production costs can be reduced. The securing element and the sleeve may be made of plastic, thereby further reducing production costs.

Optionally, the securing element may have two or more elongated members extending along the mating direction. The securing element may have an essentially U-shaped cross section, wherein the legs of the U-shaped securing element is defined by two elongated members or arms extending along the mating direction. The one or more contact pins may be provided at least partially between the elongated members of the securing element. Thus, the elongated members can protect the contact pins from physical damage.

Optionally, the securing means of the securing element may comprise a first undercut adapted to secure the connector to the counter-connector. Thus, by means of the first undercut, a secure connection can be provided, as the counter-connector can be secured or locked to the connector via the first undercut, directly, or indirectly via a further part.

In an embodiment, the securing means may comprise a second undercut adapted to secure the connector to the counter-connector. The second undercut may be located at a different position along the mating direction than the first undercut. This allows for a flexible design and usage of the connector, so that different counter-connectors can be mated with the connector, or mating at different positions can be achieved. The provision of different undercuts can also allow for using different retainers, if retainers are applied as detailed further below. A first retainer may engage the first undercut, while a different second retainer may engage the second undercut. The person skilled in the art understands that several first undercuts can be provided, as well as several second undercuts.

Optionally, the connector may comprise a coded surface at the base of the recess. The coded surface may thus face the counter-connector when mated. The coded surface may be adapted to receive torques applied to the counter-connector when connected to the connector. Thus, the coded surface may match a respective feature of the counter-connector, and provide a form-fit and/or force-fit connection to receive and pass torques. Further, the coded surface may prevent a mis-connection due to a possible mis-orientation of the connector with regard to the counter-connector.

Optionally, the coded surface may comprise one or more stepped portions. The stepped portions may be of different size, and/or may be provided at a particular angle with regard to each other, to ensure that the counter-connector with respective features engaging the coded surface can only be inserted into the connector in a desired orientation.

In an embodiment the connector may further comprise a retainer. The retainer may be provided as a separate element locked to the securing element, or may be formed integrally with the securing element. Optionally, the retainer may also be formed integrally with the securing element and the sleeve. The retainer may be of a plastic material and may be injection molded. The retainer may be adapted to secure the connector to the counter-connector. Thus, the retainer may provide a retaining function, preventing an accidental removal of the counter-connector. The retainer may provide for a connector position assurance functionality. For example, the retainer may comprise one or more retaining means adapted to hold the counter-connector in place once mated with the connector. For example, the retaining means may comprise a projection or groove which can be engaged by a respective part of the counter-connector upon mating. As the retainer is locked to the securing element, and engages the counter-connector in a retaining manner, the connector is eventually (indirectly) fixed or secured to the counter-connector.

Optionally, the retainer may comprise a locking lance adapted to lock the retainer to an undercut of the securing element. Thus, the retainer may be provided separately to the securing element. Upon mounting the retainer to the securing element, the locking lance may engage the undercut, for example the first or second undercut detailed above, and may then arrest or lock to the undercut. Thereby, the retainer can be securely fixed, thus eventually guaranteeing a secure connection of the connector to the counter-connector.

Optionally, the securing element may comprise at least two elongated members which extend along the mating direction. At each end of the elongated members, a notch may be provided, facing into the mating direction. The retainer may comprise at least two protrusions engaging these notches of the elongated members. Thus, the retainer can hold the elongated members in the desired orientation. As the elongated members could deform over time, this could eventually block any mating process. By engaging the tips of the elongated members, the retainer can prevent such deforming of the elongated members, and thus prevent undesired blocking during mating.

Optionally, the retainer may comprise a ring-shaped base with a coded structure. The coded structure may be adapted to match the coded surface of the base of the recess of the connector. Thus, as detailed above, the interplay of the coded structure of the retainer with the coded surface can allow for transferring any torques from the retainer (and thus from the counter-connector engaging the retainer) to a body of the connector. Further, this interplay can also facilitate introducing the retainer, as the interplay may only allow a single insertion orientation of the retainer. This may allow for preventing mistakes when assembling the connector.

The present disclosure further relates to a connector system comprising a connector as presented herein. Further the system comprises a counter-connector comprising a body adapted to be receivable by the recess of the connector. The counter-connector further comprises one or more mating contacts for receiving the one or more contact pins of the connector. Due to the particular arrangement of the securing element of the connector, the overall dimensions of the system can be reduced. Optionally, the system may further comprise sealing means provided in the recess of the connector between the body of the counter-connector and the sleeve of the connector. Thus, a watertight connection can be provided.

The present disclosure further relates to a retainer, as detailed herein. Optionally the retainer may provide a retaining function for the counter-connector connected to the connector described herein. The retainer may comprise two base elements having at least one opening, wherein the base elements may be provided opposite to each other. Each base element with its opening may have a ring-like structure defining the opening, eventually allowing for contact pins and mating contacts to be introduced into the retainer for mating. The retainer may further comprise one or more, optionally four ribs supporting and linking the two base elements with each other. Thus, the base elements and the ribs may define a hollow area in the retainer. Within this hollow area, the contact pins and mating contacts may be located after assembly and mating. The retainer may optionally comprise a locking lance which may be oriented at least partially towards the hollow area. Thus, the locking lance may engage a respective part inserted into the hollow area, for example an undercut part. The retainer may optionally further comprise retaining means for engaging and retaining the counter-connector.

BRIEF DESCRIPTION OF THE FIGURES

In the following, the present disclosure will be described by means of example embodiments with reference to the accompanying figures. Similar features are provided with same reference signs.

EXAMPLE EMBODIMENTS

Figure 2:
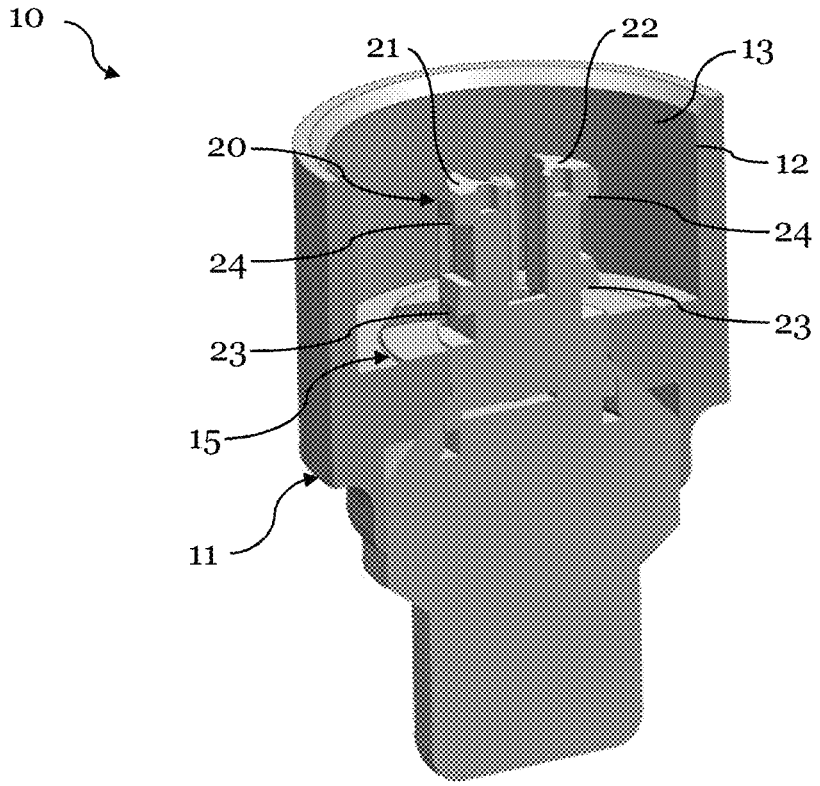
FIG. 2 illustrates a cross-sectional view of a connector 10 according to an embodiment, comprising a housing or body 11, and a securing element 20.
Figure 3:
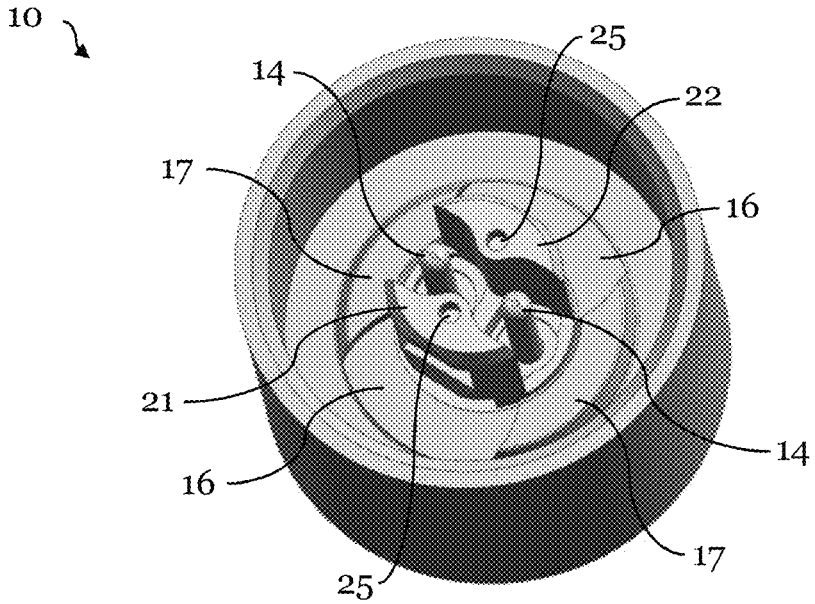
FIG. 3 illustrates the connector 10 of FIG. 2 in a different perspective.

FIG. 2 illustrates a cross-sectional-view of a connector 10 according to an embodiment. FIG. 3 illustrates a different perspective of the same connector 10. The connector 10 is generally adapted to receive a respective counter-connector for establishing an electrical connection, when connecting or mating the counter-connector along the mating direction with the connector 10. As can be seen from FIGS. 2 and 3, the general setup of the connector 10 is axis-symmetrical, or even mirror symmetrical. The axis of symmetry may be orthogonal or parallel to the mating direction. The mirror plane of symmetry may also be parallel to the mating direction, as will be appreciated by the person skilled in the art.

Figure 1:
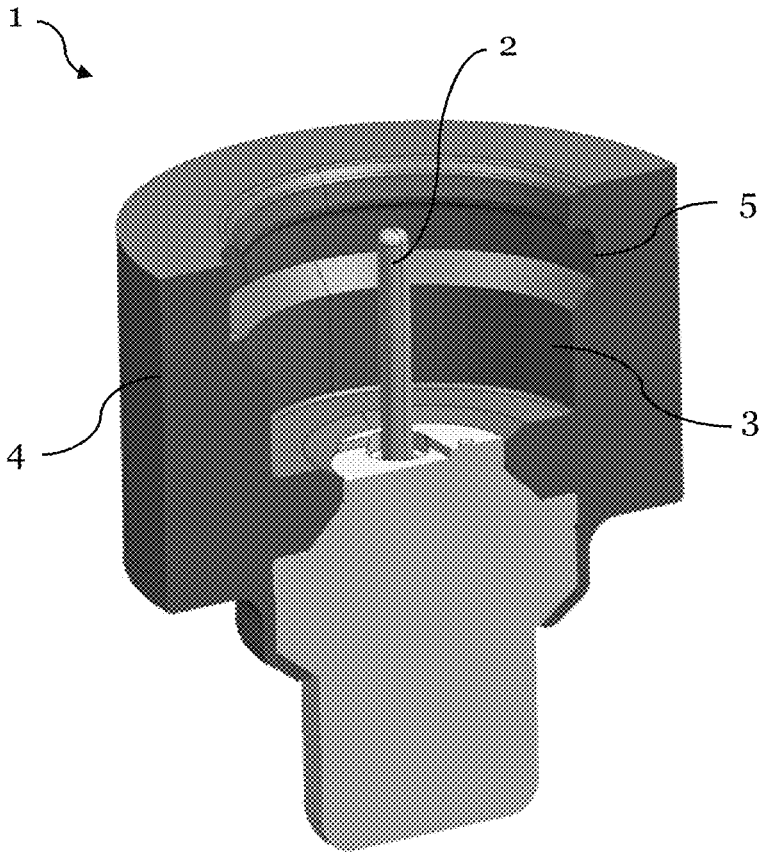
Fig. 1 (prior art)
FIG. 1 illustrates a connector according to the prior art.

The connector 10 comprises a housing or body 11 with a sleeve 12. The body 11 may be injection molded, for example, and may be of a plastic material. The sleeve 12 has a round shape, with an inner diameter of 11 mm. The sleeve 12 is for receiving a respective part (e.g. plug-in projection) of the counter-connector upon mating. The inner side of the sleeve 12 is essentially flat, besides the curvature which is a result of the round shape of the sleeve 12, so that a smooth surface is provided on the inner side of the sleeve 12. In particular, contrary to the prior art connector illustrated in FIG. 1, no undercut or the like is provided on the inside of the sleeve 12 for locking or securing the counter-connector. Thus, the inner surface of the sleeve 12 can be used as a sealing surface to provide a watertight connection.

The sleeve 12 defines a recess 13, which can be understood as the space encompassed by the sleeve 12. The recess 13 is thus bounded by the sleeve 12 and a base side of the housing 11. The recess 13 is open to the mating direction, allowing for receiving a respective part of the counter-connector. Also a retainer can be provided within the recess 13, as described herein.

The body 11 of the connector 10 features a coded surface 15 at a base side facing the counter-connector when mated. The coded surface 15 is formed at the base of the recess 13 defined by the sleeve 12. The coded surface 15 comprises stepped portions 16 and 17, wherein the stepped portion 17 extend further into the recess 13 than the other stepped portion 16. The stepped portions 16, 17 are provided at different parts of the base, each occupying a particular area thereof. Thus, by means of the difference in height of the stepped portions 16, 17, and by means of the particular arrangement of the stepped portions 16,17, a coding is provided requiring a respective counter-coding of the retainer or counter-connector to match said coding of the coded surface 15 for a proper connection. This prevents a mis-orientation of the retainer or counter-connector when inserted into the connector 10. The coded surface 15 allows for a form-fit connection with a respective counter-part, for example of the counter-connector or retainer, so that the connection is more resistive against torsional forces acting on the counter-connector, for example.

The connector 10 further comprises two contact pins 14. The contact pins 14 are provided at a rather central position of the recess 13. The contact pins 14 are gold-plated and extend along the mating direction to establish the electrical connection when the connector 10 is mated with the counter-connector.

Within the recess 13 and apart from the sleeve 12, a securing element 20 is provided in the connector 10. In a cross-sectional view, the securing element 20 has a U-shaped form. The securing element 20 comprises two elongated members or arms 21, 22, which extend along the mating direction. The arms 21, 22 encompass the contact pins 14 at least partially and extend farther along the mating direction than the contact pins 14, thus protecting the pins 14 from physical damage.

At each one of the arms 21, 22 of the securing element 20, a first locking undercut 23 is provided at a position close to the base of the recess 13. This first locking undercut 23 can be engaged by respective locking means of the counter-connector or retainer, for securing or locking it to the securing element 20. Further, besides the first locking undercut 23, a second locking undercut 24 is provided at each one of the arms 21, 22 of the securing element 20. The second locking undercut 24 is provided at a different position along the mating direction than the first locking undercut 23, i.e. closer to the tip of the arms 21, 22. The provision of different locking undercuts allows for connecting different counter-connectors with individual locking means to the connector 10, for example. Also, different retainers may be assembled on the securing element 20. The person skilled in the art understands that further locking undercuts may be provided, to allow for using the connector 10 with alternative counter-connectors or retainers.

At each tip of the arms 21, 22 of the securing element 20, a notch 25 is provided. Said notches 25 can be engaged by respective means of the counter-connector or the retainer for preserving the U-shaped form of the securing element 20. As will be understood by the person skilled in the art, the arms 21, 22 may deform due to manufacturing conditions, as they may tend to bend to the inside of the U-shaped form. By engaging the notches 25, such a deformation can be prevented.

As the securing functionality is provided with the securing element 20 and not with the sleeve 13, the sleeve 13 can be provided is a simpler manner, allowing for reducing the overall dimensions of the connector 10. Thus, also the length of the contact pins can be reduced. Further, the smooth surface of the sleeve 13 can function as a sealing surface, thus providing for a watertight connection.

Figure 4:
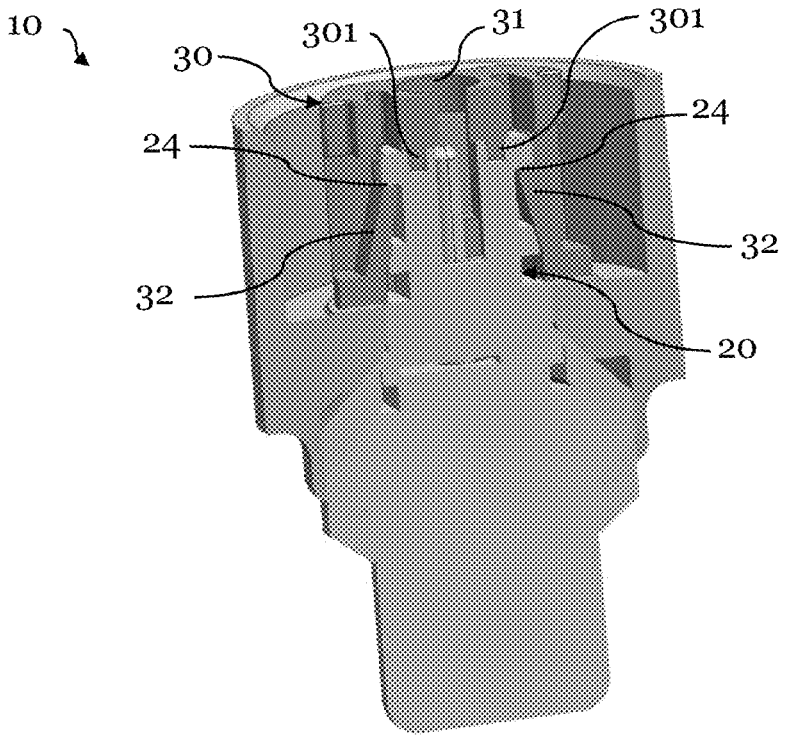
FIG. 4 illustrates a cross-sectional view of a connector 10 according to a further embodiment, comprising a housing or body 11, a securing element 20 and a retainer 30.
Figure 5:
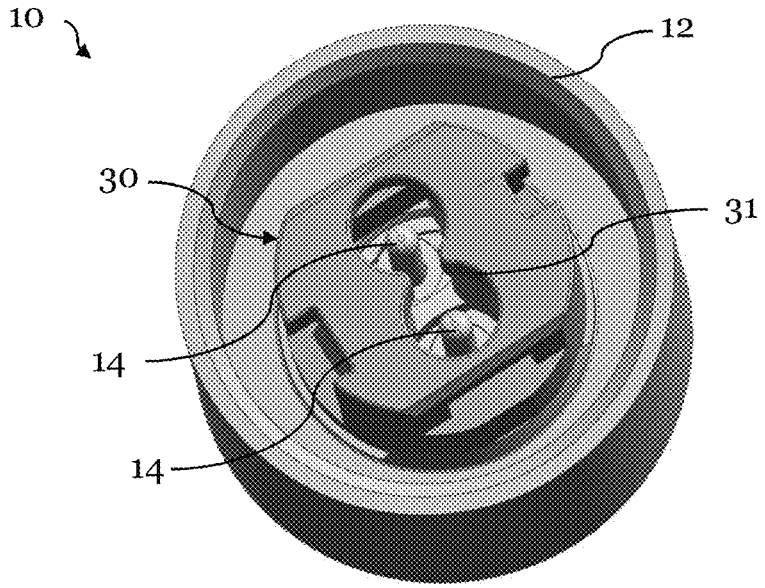
FIG. 5 illustrates the connector 10 of FIG. 4 in a different perspective.

FIGS. 4 and 5 illustrate a cross-sectional-view of a connector 10 according to further embodiment, which corresponds to the most part to the connector of FIGS. 2 and 3 but with the addition of a retainer 30. The retainer 30 is assembled to the securing element 20, and can provide a retaining function when the counter-connector is mated.

The retainer 30 encompasses the securing element 20 and the contact pins 14, and has an opening 31 which allows for engaging the contact pins by the counter-connector upon mating. The retainer further features two locking lances 32, which engage the second locking undercuts 24 of the arms 24, 25 of the securing element 20. When the retainer 30 is pushed on the securing element 20 upon assembly, the locking lances 32 are flexed due to the engagement with the arms 24, 25 of the securing element 20. Once the retainer 30 is fully pushed on the securing element 20, the locking lances 32 are released and can return to their locking position, in which they engage the second locking undercuts 24, preventing an unwanted removal of the retainer 30. For unmounting the retainer 30, the locking lances 32 need to be flexed, as understood by the person skilled in the art.

As illustrated in FIG. 4, two protrusions 301 of the retainer 30 engage the notches 25 of the securing element 20. This engagement preserves the overall structure of the securing element 20, as for example a deformation of the arms 21, 22 of the securing element 20 is prevented.

Figure 6:
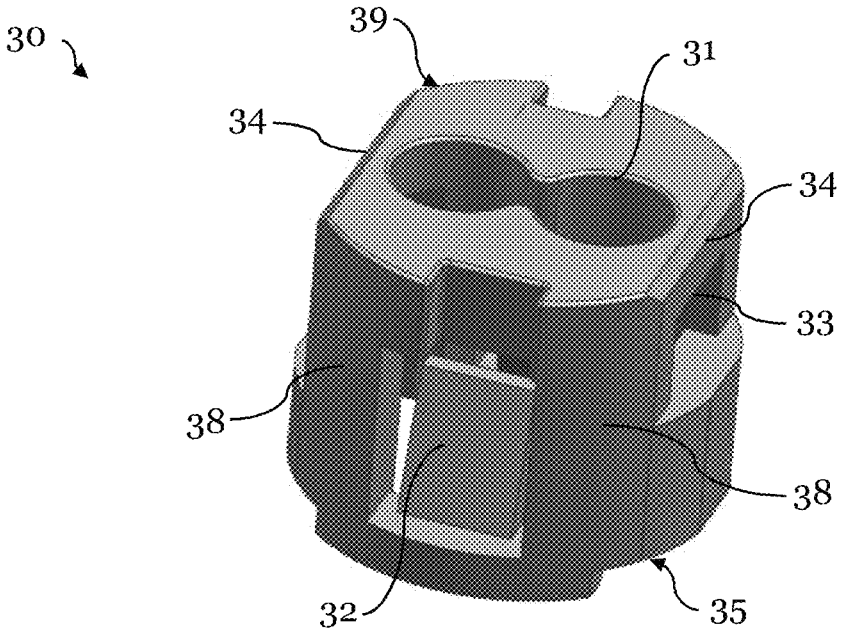
FIGS. 6 and 7 illustrate different views of a retainer 30 according to a further embodiment, which retainer 30 may secure a connection of a connector to a counter-connector.
Figure 7:
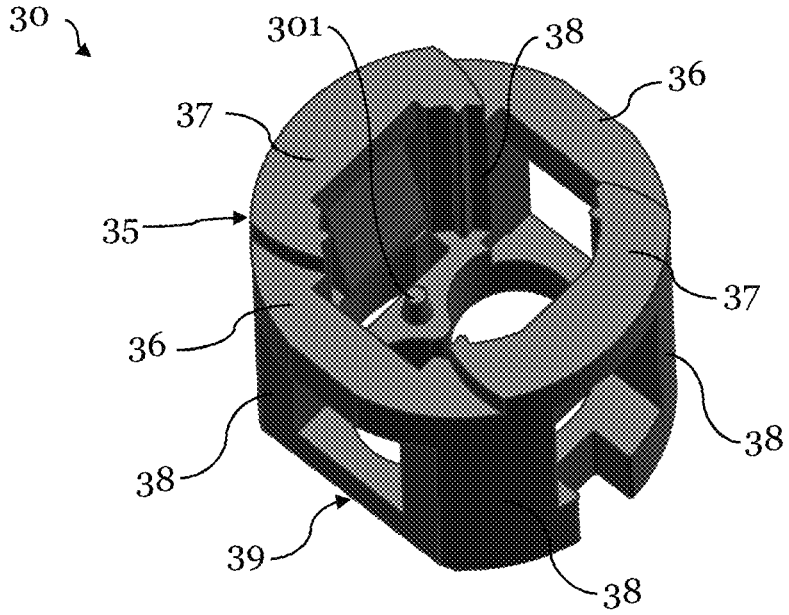

FIGS. 6 and 7 illustrate the retainer 30 as used with the connector 10 illustrated in FIGS. 4 and 5. The retainer 30 is provided as a separate member, but can also be formed integrally with the body 11 of the connector 10 as will be appreciated by the person skilled in the art. The retainer 30 may be injection molded and be of a plastic material. The retainer 30 generally comprises two base elements 35, 39, linked by four ribs 38.

The retainer 30 comprises two lateral ports 33 which can be engaged by the counter-connector for fixing the counter-connector to the retainer and thus to the connector 10. The ports 33 can for example be engaged by respective lances of the counter-connector.

The retainer 30 further comprises two grooves 34 provided at different sides of the retainer 30. These grooves 34 can function as a positioning guide, to facilitate a correct insertion with a proper orientation of the counter-connector on the retainer 30 and thus to the connector 10.

As can be seen in particular in FIG. 7, the retainer 30 comprises a ring-shaped base element 35 with a coded structure. The coded structure of the base element 35 is defined by stepped parts 36, 37, which have a different height, and are provided at distinct positions of the retainer 30. The arrangement and configuration of the stepped parts 36, 37 provides for a coded structure of the base element 35 which matches the coded surface 15 of the base of the recess 13. Thus, the retainer 30 can only be attached to the securing element 20 in a defined manner, as such attachment is blocked if the stepped parts 36, 37 of the retainer 30 are not positioned to match the coded surface 15 of the base of the recess 13.

FIG. 7 further illustrates a protrusion 301, which is configured for engaging a respective notch 25 of the securing element 20. As will be appreciated by the person skilled in the art, such notches and protrusions may be provided at various positions on the securing element and retainer or counter-connector, however, they should be provided such that they can come into engagement for preventing any deformation of the securing element.

Figure 8:
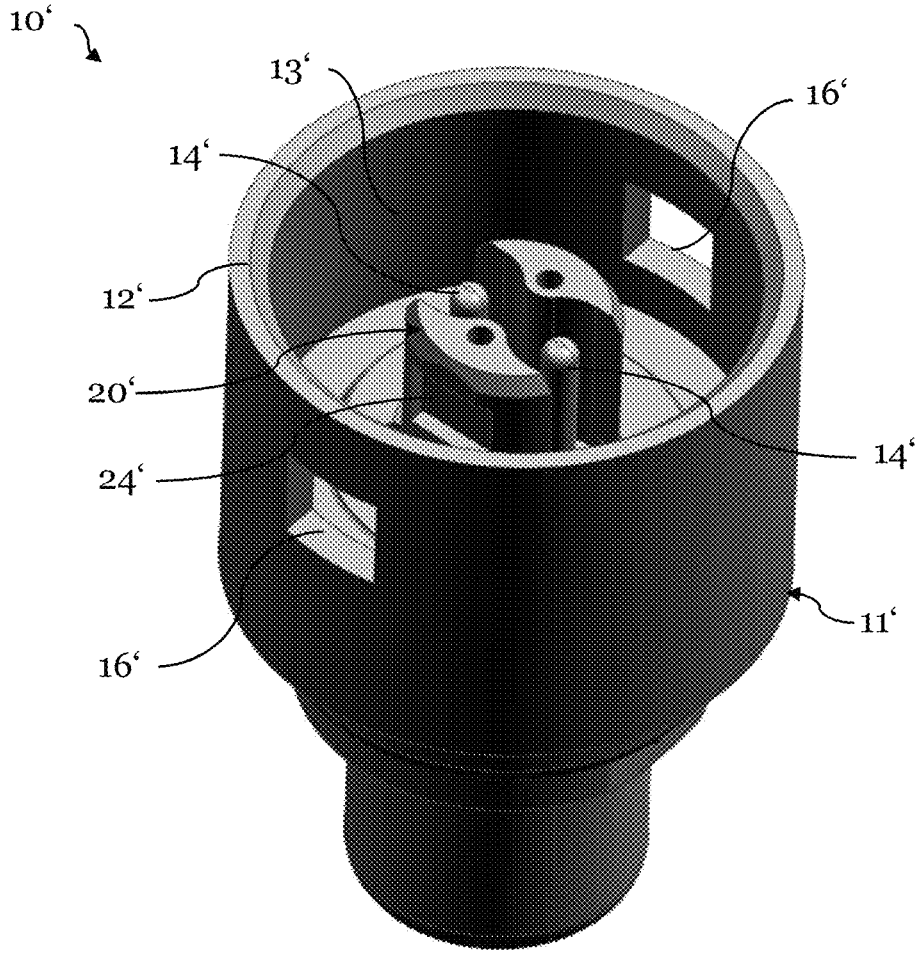
FIG. 8 illustrates a connector 10' according to a further embodiment, wherein a body or housing 11' and a securing element 20' are integrally formed.

FIG. 8 illustrates a connector 10' according to a further embodiment. The connector 10' comprises a body 11', sleeve 12' defining a recess 13', two contact pins 14', and a securing element 20'. The body 11' with the sleeve 12' and the securing element 20' are thereby integrally formed. As detailed above, the securing element 20 comprises locking undercuts 24', which allow for locking a counter-connector or a retainer.

The sleeve 12' of the connector 10' features two apertures 16', which are required for fabricating the locking undercuts 24' for example when producing the integral setup with injection molding. They, however, are not provided for interacting with a retainer or counter-connector. According to the present disclosure, a retainer or counter-connector are secured by means of the securing element 20', which is provided apart from the sleeve 12', for example at a central position nearby the contact pins 14'. Thus, the inner surface of the sleeve 12' is essentially smooth.

What is claimed:

1. A connector for mating with a counter-connector, the connector comprising:

a sleeve defining a recess and adapted to receive the counter-connector at least partially, an inner surface of the sleeve being essentially smooth, the recess bounded by the inner surface of the sleeve and a base of the recess formed by a base side of a housing, the recess open to a mating direction of the connector;

one or more contact pins located in the recess and extending along the mating direction of the connector; and a securing element located in the recess away from the inner surface of the sleeve and surrounded by the recess, the securing element:

extending from the base of the recess along the mating direction;

having first and second opposing ends, the first end attached to the base of the recess, the second end defining a notch facing the mating direction, the notch configured to engage a respective means of the counter-connector for preserving a shape of the securing element;

including inner and outer side walls that connect the first and second opposing ends, the inner side wall facing the one or more contact pins, the outer side wall facing away from the one or more contact pins and toward the inner surface of the sleeve, the outer side wall located entirely away from the inner surface of the sleeve; and comprising securing means for securing the connector to the counter-connector.

2. The connector of claim 1, wherein the sleeve extends farther along the mating direction of the connector than the one or more contact pins or the securing element.

3. The connector of claim 1, wherein the one or more contact pins are encompassed by the securing element at least partially, and wherein the securing element extends farther than the one or more contact pins along the mating direction of the connector.

4. The connector of claim 1, wherein a length of the one or more contact pins is in a range of 3.4-6.4 mm.

5. The connector of claim 1, wherein the securing element has an essentially U-shaped cross section with two elongated members extending along the mating direction, and wherein the one or more contact pins are provided between the two elongated members of the securing element.

6. The connector of claim 1, wherein the securing means comprise a first undercut adapted to secure the connector to the counter-connector, wherein the first undercut is located on the outer side wall of the securing element.

7. The connector of claim 6, wherein the securing means comprise a second undercut adapted to secure the connector to the counter-connector, wherein the second undercut is located at a different position on the outer side wall of the securing element along the mating direction than the first undercut.

8. The connector of claim 1, wherein the connector comprises a coded surface at the base of the recess, the coded surface being adapted to receive torques applied to the counter-connector when connected to the connector.

9. The connector of claim 8, wherein the coded surface comprises one or more stepped portions.

10. A system comprising:

a connector comprising:

a sleeve defining a recess and adapted to receive a counter-connector at least partially, an inner surface of the sleeve being essentially smooth, the recess defined by the inner surface of the sleeve and a base of the recess formed by a base side of a housing of the connector;

one or more contact pins located in the recess and extending along a mating direction of the connector, the one or more contact pins adapted to mate with one or more mating contacts on the counter-connector; and a securing element located in the recess entirely away from the inner surface of the sleeve effective to enable the connector to receive the counter-connector in the recess between the securing element and the inner surface of the sleeve, the securing element extending from the base of the recess along the mating direction, the securing element having a side wall facing away from the one or more pins and toward the inner surface of the sleeve such that the securing element is surrounded by the recess, the securing element having a tip that defines a notch facing the mating direction, the notch configured to engage a respective means of the counter-connector for preserving a shape of the securing element, the securing element comprising securing means for securing the connector to the counter-connector; and sealing means provided in the recess at the inner surface of the sleeve for providing a watertight seal between the sleeve of the connector and a body of the counter-connector when the connector is mated with the counter-connector.

11. The system of claim 10, wherein:

the one or more contact pins are encompassed by the securing element at least partially; and the securing element extends farther than the one or more contact pins along the mating direction of the connector.

12. The system of claim 10, wherein:

the securing element has an essentially U-shaped cross section with two elongated members extending along the mating direction; and the one or more contact pins are provided between the two elongated members of the securing element.

13. The system of claim 12, wherein the securing means further comprise a first undercut located on at least one of the two elongated members and adapted to secure the connector to the counter-connector.

14. The system of claim 13, wherein the first undercut is located on the side wall of the securing means that faces the inner surface of the sleeve.

15. The system of claim 13, wherein:

the securing means further comprise a second undercut adapted to secure the connector to the counter-connector; and the second undercut is located on the at least one of the two elongated members and at a different position along the mating direction than the first undercut.

16. The system of claim 15, wherein the first undercut is closer to a base of the recess than the second undercut.

17. The system of claim 15, wherein the first undercut and the second undercut are each located on the side wall that faces away from the one or more contact pins and toward the inner surface of the sleeve of the connector.

18. The system of claim 10, wherein:

the connector further comprises a coded surface at a base of the recess; and the coded surface is adapted to receive torque forces applied to the counter-connector when connected to the connector.

19. The system of claim 18, wherein the coded surface comprises one or more stepped portions.

20. The system of claim 19, wherein:

the one or more stepped portions include at least first and second stepped portions adapted to define an orientation of the connector relative to the counter-connector when connected to the connector;

the first stepped portion having a first height; and the second stepped portion having a second height that is different than the first height of the first stepped portion.

* * * * *